US012545366B2

(12) United States Patent
Murphy

(10) Patent No.: US 12,545,366 B2
(45) Date of Patent: Feb. 10, 2026

(54) RIGID WATERCRAFT WITH INFLATABLE PORTION

(71) Applicant: Joy Sports Co., Ltd., Bangkok (TH)

(72) Inventor: Peter James Murphy, Chon Buri Province (TH)

(73) Assignee: Joy Sports Co., Ltd., Bangkok (TH)

( * ) Notice: Subject to any disclaimer, the term of this patent is extended or adjusted under 35 U.S.C. 154(b) by 683 days.

(21) Appl. No.: 17/858,265

(22) Filed: Jul. 6, 2022

(65) Prior Publication Data

US 2024/0010299 A1 Jan. 11, 2024

(51) Int. Cl.
*B63B 7/08* (2020.01)
*B63H 21/17* (2006.01)
*B63H 21/20* (2006.01)

(52) U.S. Cl.
CPC ..... *B63B 7/082* (2013.01); *B63H 21/17* (2013.01); *B63H 21/20* (2013.01)

(58) Field of Classification Search
CPC ..... B63B 7/082; B63H 21/17; B63H 21/20
See application file for complete search history.

(56) References Cited

U.S. PATENT DOCUMENTS 3,170,174 A 2/1965 Hanel
3,556,039 A * 1/1971 Sfredda ..... B63H 25/46 440/17
4,597,355 A 7/1986 Kirby
6,223,678 B1 5/2001 Haller et al.
6,263,827 B1 7/2001 Szigeti
6,539,889 B2 4/2003 Simpson
7,021,233 B2 4/2006 Hall et al.
7,121,909 B1 * 10/2006 Meyerhoffer ..... B63B 32/53 441/74
7,721,670 B2 5/2010 Weber
8,082,871 B2 12/2011 Czarnowski et al.
(Continued)

FOREIGN PATENT DOCUMENTS

WO 2018143898 A1 8/2018

OTHER PUBLICATIONS

Bote, LLC, "Rackham Aero 12'4" Verge Camo Inflatable Paddle Board", Apr. 13, 2021, https://www.boteboard.com/collections/inflatable-paddle-boards/products/rackham-aero-124-verge-camo-inflatable-paddle-board.

(Continued)

*Primary Examiner* — Stephen P Avila
(74) *Attorney, Agent, or Firm* — The Webb Law Firm

(57) ABSTRACT

A watercraft includes a central platform having a bow portion and a stern portion removably connectable to each other to define a rigid hull. The central platform further includes an upper flange and a lower flange each extending around at least a portion of an outer perimeter of the central platform. The upper flange and the lower flange are separated by a recessed pocket. The watercraft further includes an air-inflatable tube fitted around at least a portion of an outer perimeter of the central platform. When inflated, the air-inflatable tube is at least partially received within the recessed pocket. At least one first locking element is provided on the central platform and at least one second locking element is provided on the air-inflatable tube. The at least one first locking element and the at least one second locking element are configured for locking engagement with each other.

19 Claims, 7 Drawing Sheets

(56) References Cited

U.S. PATENT DOCUMENTS

| | | | | |
|---|---|---|---|---|
| 8,438,986 | B2 | 5/2013 | Haller et al. | |
| 9,751,599 | B1 | 9/2017 | Ebrahimi | |
| 9,908,595 | B1 | 3/2018 | Kokinelis | |
| 2009/0165695 | A1 | 7/2009 | Fritsch | |
| 2011/0146561 | A1* | 6/2011 | McLean | B63B 7/04 114/352 |
| 2014/0245943 | A1* | 9/2014 | Swan | B63B 32/40 114/345 |
| 2019/0143617 | A1 | 5/2019 | Klare | |
| 2021/0171173 | A1 | 6/2021 | Kramer | |
| 2021/0245847 | A1 | 8/2021 | Senie et al. | |
| 2021/0323638 | A1* | 10/2021 | Frodé | B63B 34/22 |

OTHER PUBLICATIONS

Hobie, "Mirage Lynx", May 14, 2021, https://www.hobie.com/kayaks/mirage-lynx/.

Starboard, "SUP Windsurf Inflatable", Jan. 23, 2021, https://sup.star-board.com/paddle-board/inflatable-paddle-board/sup-windsurfing-inflatable/.

* cited by examiner

RIGID WATERCRAFT WITH INFLATABLE PORTION

BACKGROUND OF THE DISCLOSURE

Field of the Disclosure

The present disclosure relates generally to a recreational watercraft, and more particularly to a small watercraft having a rigid portion and an inflatable portion.

Description of Related Art

Various recreational watercraft, such as kayaks, stand-up paddle boards, and canoes, are known in the art. Primarily, these watercraft are made from a one-piece, rigid plastic material that substantially retains its shape. Such construction makes these watercraft relatively heavy. Due to the rigid construction, these watercraft also require a substantial amount of space for storage when not in use, and can also be cumbersome to transport. An alternative to the one-piece rigid watercraft is an inflatable watercraft, which is made from a flexible fabric material that can be deflated when not in use for ease of transportation and storage. A disadvantage of inflatable watercraft is that they have poor performance compared to their rigid counterparts.

There exists a need in the art for an improved watercraft that overcomes the disadvantages of the existing rigid and inflatable watercraft. It would be desirable to have a watercraft with performance characteristics of a rigid watercraft, without the weight and size penalty that makes these types of watercraft difficult to transport and store.

SUMMARY OF THE DISCLOSURE

In accordance with some non-limiting embodiments or aspects of the present disclosure, provided is a watercraft that may include a central platform with a bow portion and a stern portion removably connectable to each other to define a rigid hull; and an air-inflatable tube fitted around at least a portion of an outer perimeter of the central platform. When inflated, the air-inflatable tube may be at least partially received within a recessed pocket extending around at least a portion of the outer perimeter of the central platform.

In accordance with some non-limiting embodiments or aspects of the present disclosure, the bow portion may include a first connector set and the stern portion may include a second connector set. The first connector set and the second connector set may be configured to releasably connect the bow portion to the stern portion. The first connector set may include a protrusion and the second connector set may include a cavity. The protrusion may be at least partially inserted into the cavity when the bow portion is connected to the stern portion. The central platform may include an upper flange and a lower flange each extending around at least a portion of an outer perimeter of the central platform. The upper flange and the lower flange may be separated by the recessed pocket.

In accordance with some non-limiting embodiments or aspects of the present disclosure, the central platform may include at least one first locking element, and the air-inflatable tube may include at least one second locking element. The at least one first locking element and the at least one second locking element may be configured for locking engagement with each other. The at least one first locking element may be a slotted channel. The at least one second locking element may be a flexible fabric loop configured to be received within the slotted channel. A locking plug may be received in the flexible fabric loop to lock the flexible fabric loop within the slotted channel.

In accordance with some non-limiting embodiments or aspects of the present disclosure, the central platform may be made from a rigid plastic material. The air-inflatable tube may be made from a flexible plastic material or a drop stitched fabric material. The air-inflatable tube may include a drop-stitched core having a plurality of threads extending through an inner cavity between opposing surfaces.

In accordance with some non-limiting embodiments or aspects of the present disclosure, the watercraft may include a propulsion mechanism connected to the central platform, wherein the propulsion mechanism is configured to provide motive power to the watercraft. The propulsion mechanism may be a manual propulsion mechanism configured to receive mechanical input from a user. The propulsion mechanism may be a motor propulsion mechanism configured to receive mechanical input from an electric motor. In some embodiments or aspects, the propulsion mechanism may be a hybrid propulsion mechanism configured to receive a first mechanical input from a user and a second mechanical input from an electric motor.

In accordance with some non-limiting embodiments or aspects of the present disclosure, the watercraft may be a kayak, a stand-up paddle board, or a canoe.

In accordance with some non-limiting embodiments or aspects of the present disclosure, provided is a watercraft that may include a central platform with a bow portion and a stern portion removably connectable to each other to define a rigid hull. The central platform further may include an upper flange and a lower flange each extending around at least a portion of an outer perimeter of the central platform, wherein the upper flange and the lower flange are separated by a recessed pocket. The watercraft further may include an air-inflatable tube fitted around at least a portion of an outer perimeter of the rigid hull. When inflated, the air-inflatable tube may be at least partially received within the recessed pocket. The central platform may include at least one first locking element, and the air-inflatable tube may include at least one second locking element. The at least one first locking element and the at least one second locking element may be configured for locking engagement with each other.

In accordance with some non-limiting embodiments or aspects of the present disclosure, the bow portion may include a first connector set and the stern portion may include a second connector set. The first connector set and the second connector set may be configured to releasably connect the bow portion to the stern portion.

In accordance with some non-limiting embodiments or aspects of the present disclosure, a propulsion mechanism may be connected to the central platform, wherein the propulsion mechanism is configured to provide motive power to the watercraft.

In accordance with some non-limiting embodiments or aspects of the present disclosure, the central platform may be made from a rigid plastic material, and the air-inflatable tube may be made from a flexible plastic material or a fabric material with a drop-stitched core having a plurality of threads extending through an inner cavity between opposing surfaces.

In accordance with some non-limiting embodiments or aspects of the present disclosure, provided is a watercraft that may include a central platform with a bow portion and a stern portion removably connectable to each other to define a rigid hull. The central platform may include an upper flange and a lower flange each extending around at least a portion of an outer perimeter of the central platform. The upper flange and the lower flange may be separated by a recessed pocket. The watercraft further may include an air-inflatable tube with a drop-stitched core having a plurality of threads extending through an inner cavity between opposing surfaces. The air-inflatable tube may be configured for being fitted around at least a portion of an outer perimeter of the central platform. When inflated, the air-inflatable tube may be at least partially received within the recessed pocket. The central platform may include at least one first locking element, and the air-inflatable tube may include at least one second locking element. The at least one first locking element and the at least one second locking element may be configured for locking engagement with each other.

Further non-limiting embodiments or aspects of the present disclosure are set forth in the following numbered clauses:

Clause 1: A watercraft comprising: a central platform comprising a bow portion and a stern portion removably connectable to each other to define a rigid hull; and an air-inflatable tube fitted around at least a portion of an outer perimeter of the central platform, wherein, when inflated, the air-inflatable tube is at least partially received within a recessed pocket extending around at least a portion of the outer perimeter of the central platform.

Clause 2: The watercraft of claim 1, wherein the bow portion comprises a first connector set and the stern portion comprises a second connector set, and wherein the first connector set and the second connector set are configured to releasably connect the bow portion to the stern portion.

Clause 3: The watercraft of claim 2, wherein the first connector set comprises a protrusion and wherein the second connector set comprises a cavity, and wherein the protrusion is at least partially inserted into the cavity when the bow portion is connected to the stern portion.

Clause 4: The watercraft of claim 1, wherein the central platform comprises an upper flange and a lower flange each extending around at least a portion of an outer perimeter of the central platform, and wherein the upper flange and the lower flange are separated by the recessed pocket.

Clause 5: The watercraft of claim 1, wherein the central platform comprises at least one first locking element, wherein the air-inflatable tube comprises at least one second locking element, and wherein the at least one first locking element and the at least one second locking element are configured for locking engagement with each other.

Clause 6: The watercraft of claim 5, wherein the at least one first locking element is a slotted channel.

Clause 7: The watercraft of claim 6, wherein the at least one second locking element is a flexible fabric loop configured to be received within the slotted channel.

Clause 8: The watercraft of claim 7, further comprising a locking plug received in the flexible fabric loop to lock the flexible fabric loop within the slotted channel.

Clause 9: The watercraft of claim 1, wherein the central platform is made from a rigid plastic material.

Clause 10: The watercraft of claim 1, wherein the air-inflatable tube is made from a flexible plastic material or a drop stitched fabric material.

Clause 11: The watercraft of claim 1, wherein the air-inflatable tube comprises a drop-stitched core having a plurality of threads extending through an inner cavity between opposing surfaces.

Clause 12: The watercraft of claim 1, further comprising a propulsion mechanism connected to the central platform, wherein the propulsion mechanism is configured to provide motive power to the watercraft.

Clause 13: The watercraft of claim 12, wherein the propulsion mechanism is a manual propulsion mechanism configured to receive mechanical input from a user, or wherein the propulsion mechanism is a motor propulsion mechanism configured to receive mechanical input from an electric motor.

Clause 14: The watercraft of claim 12, wherein the propulsion mechanism is a hybrid propulsion mechanism configured to receive a first mechanical input from a user and a second mechanical input from an electric motor.

Clause 15: The watercraft of claim 1, wherein the watercraft is a kayak, a stand-up paddle board, or a canoe.

Clause 16: A watercraft comprising: a central platform comprising a bow portion and a stern portion removably connectable to each other to define a rigid hull, the central platform comprising an upper flange and a lower flange each extending around at least a portion of an outer perimeter of the central platform, wherein the upper flange and the lower flange are separated by a recessed pocket; and an air-inflatable tube fitted around at least a portion of an outer perimeter of the rigid hull, wherein, when inflated, the air-inflatable tube is at least partially received within the recessed pocket, wherein the central platform comprises at least one first locking element, wherein the air-inflatable tube comprises at least one second locking element, and wherein the at least one first locking element and the at least one second locking element are configured for locking engagement with each other.

Clause 17: The watercraft of claim 1, wherein the bow portion comprises a first connector set and the stern portion comprises a second connector set, and wherein the first connector set and the second connector set are configured to releasably connect the bow portion to the stern portion.

Clause 18: The watercraft of claim 1, further comprising a propulsion mechanism connected to the central platform, wherein the propulsion mechanism is configured to provide motive power to the watercraft.

Clause 19: The watercraft of claim 1, wherein the central platform is made from a rigid plastic material, and wherein the air-inflatable tube is made from a flexible plastic or fabric material with a drop-stitched core having a plurality of threads extending through an inner cavity between opposing surfaces.

Clause 20: A watercraft comprising: a central platform comprising a bow portion and a stern portion removably connectable to each other to define a rigid hull, the central platform comprising an upper flange and a lower flange each extending around at least a portion of an outer perimeter of the central platform, wherein the upper flange and the lower flange are separated by a recessed pocket; and an air-inflatable tube comprising a drop-stitched core having a plurality of threads extending through an inner cavity between opposing surfaces, the air-inflatable tube configured for being fitted around at least a portion of an outer perimeter of the central platform, wherein, when inflated, the air-inflatable tube is at least partially received within the recessed pocket, wherein the central platform comprises at least one first locking element, wherein the air-inflatable tube comprises at least one second locking element, and wherein the at least one first locking element and the at least one second locking element are configured for locking engagement with each other.

These and other features and characteristics of the present disclosure, as well as the methods of operation and functions of the related elements of structures and the combination of parts and economies of manufacture, will become more apparent upon consideration of the following description and with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the disclosure.

DETAILED DESCRIPTION

Figure 1:
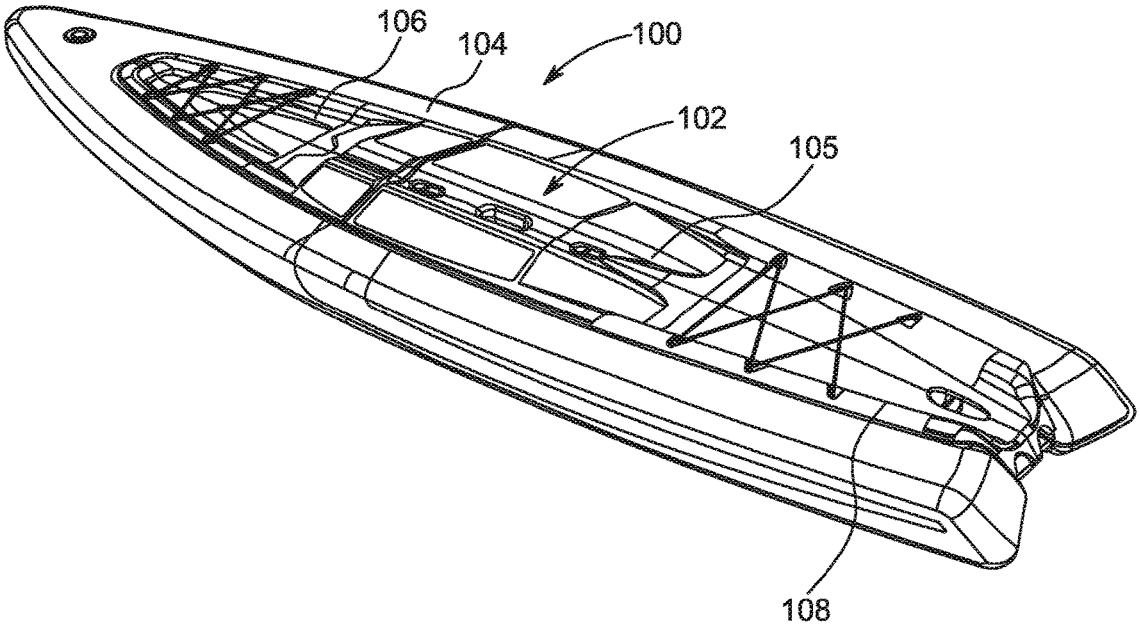
FIG. 1 is a top perspective view of a watercraft in accordance with some non-limiting embodiments or aspects of the present disclosure.

As used herein, the singular form of "a", "an", and "the" include plural referents unless the context clearly dictates otherwise.

Spatial or directional terms, such as "left", "right", "inner", "outer", "above", "below", and the like, relate to the embodiments or aspects as shown in the drawing figures and are not to be considered as limiting as the embodiments or aspects can assume various alternative orientations.

All numbers used in the specification and claims are to be understood as being modified in all instances by the term "about". By "about" is meant within plus or minus twenty-five percent of the stated value. However, this should not be considered as limiting to any analysis of the values under the doctrine of equivalents.

Unless otherwise indicated, all ranges or ratios disclosed herein are to be understood to encompass the beginning and ending values and any and all subranges or subratios subsumed therein. For example, a stated range or ratio of "1 to 10" should be considered to include any and all subranges or subratios between (and inclusive of) the minimum value of 1 and the maximum value of 10; that is, all subranges or subratios beginning with a minimum value of 1 or more and ending with a maximum value of 10 or less. The ranges and/or ratios disclosed herein represent the average values over the specified range and/or ratio.

The terms "first", "second", and the like are not intended to refer to any particular order or chronology, but refer to different conditions, properties, or elements.

All documents referred to herein are "incorporated by reference" in their entirety.

The term "at least" is synonymous with "greater than or equal to".

As used herein, "at least one of" is synonymous with "one or more of". For example, the phrase "at least one of A, B, or C" means any one of A, B, or C, or any combination of any two or more of A, B, or C. For example, "at least one of A, B, and C" includes A alone; or B alone; or C alone; or A and B; or A and C; or B and C; or all of A, B, and C.

The word "comprising" and "comprises", and the like, does not exclude the presence of elements or steps other than those listed in any claim or the specification as a whole. In the present specification, "comprises" means "includes" and "comprising" means "including".

As used herein, the terms "parallel" or "substantially parallel" mean a relative angle as between two objects (if extended to theoretical intersection), such as elongated objects and including reference lines, that is from 0° to 5°, or from 0° to 3°, or from 0° to 2°, or from 0° to 1°, or from 0° to 0.5°, or from 0° to 0.25°, or from 0° to 0.1°, inclusive of the recited values.

As used herein, the terms "perpendicular", "transverse", "substantially perpendicular", or "substantially transverse" mean a relative angle as between two objects at their real or theoretical intersection is from 85° to 90°, or from 87° to 90°, or from 88° to 90°, or from 89° to 90°, or from 89.5° to 90°, or from 89.75° to 90°, or from 89.9° to 90°, inclusive of the recited values.

As used herein, the term "rigid", when used in reference to a central portion of a watercraft, refers to a central portion that has inherent stiffness or hardness such that the central portion is unable to be bent or forced out of shape. The term "rigid" is opposite of the term "flexible".

As used herein, the term "flexible", when used in reference to an air-inflatable portion of a watercraft, refers to an air-inflatable portion that is capable bending easily with application of force. The term "flexible" is opposite of the term "rigid".

As used herein, the term "bow portion" refers to front portion of a watercraft when viewed in a normal direction of travel.

As used herein, the term "stern portion" refers to a back or aft-most portion of a watercraft when viewed in a normal direction of travel.

The discussion of various embodiments or aspects may describe certain features as being "particularly" or "preferably" within certain limitations (e.g., "preferably", "more preferably", or "even more preferably", within certain limitations). It is to be understood that the disclosure is not limited to these particular or preferred limitations but encompasses the entire scope of the various embodiments and aspects described herein.

The disclosure comprises, consists of, or consists essentially of, the following embodiments or aspects, in any combination. Various embodiments or aspects of the disclosure are illustrated in separate drawing figures. However, it is to be understood that this is simply for ease of illustration and discussion. In the practice of the disclosure, one or more embodiments or aspects shown in one drawing figure can be combined with one or more embodiments or aspects shown in one or more of the other drawing figures.

With initial reference to FIG. 1, a watercraft 100 is shown in accordance with some non-limiting embodiments or aspects of the present disclosure. For example, the watercraft 100 may be a small watercraft configured for personal recreational use. In some embodiments or aspects, the watercraft 100 may be a kayak, a stand-up paddle board, or a canoe.

The watercraft 100 generally includes a central platform 102 and an air-inflatable tube 104 fitted around at least a portion of an outer perimeter of the central platform 102. In some embodiments or aspects, the air-inflatable tube 104 extends around a portion of the outer perimeter of the central platform 102 such that a part of the central platform 102 is not enveloped by the air-inflatable tube 104. In other embodiments or aspects, the air-inflatable tube 104 extends around the entire outer perimeter of the central platform 102. Once inflated, the air-inflatable tube 104 is configured to be fixedly connected to the central platform 102 and cannot be removed without deflating the air-inflatable tube 104.

With continued reference to FIG. 1, a lower portion of the central platform 102 and the air-inflatable tube 104 is configured for being placed in the water for floatably supporting the watercraft 100 in the water. An upper portion 105 of the central platform 102 is configured for supporting a user and cargo.

Figure 2:
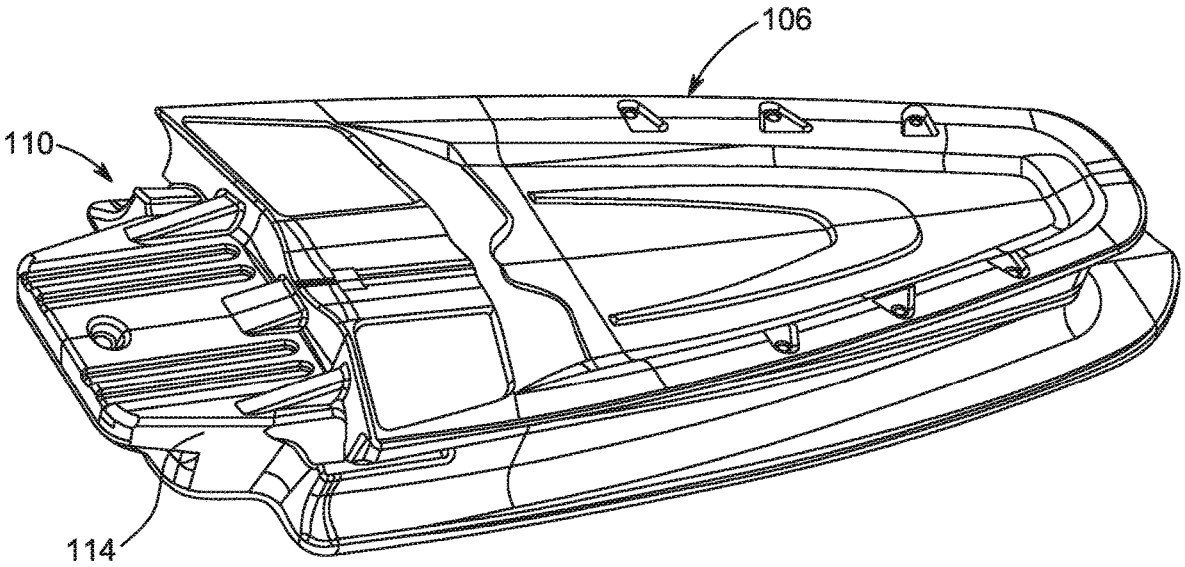
FIG. 2 is a perspective view of a bow portion of a central platform shown in FIG. 1.
Figure 3:
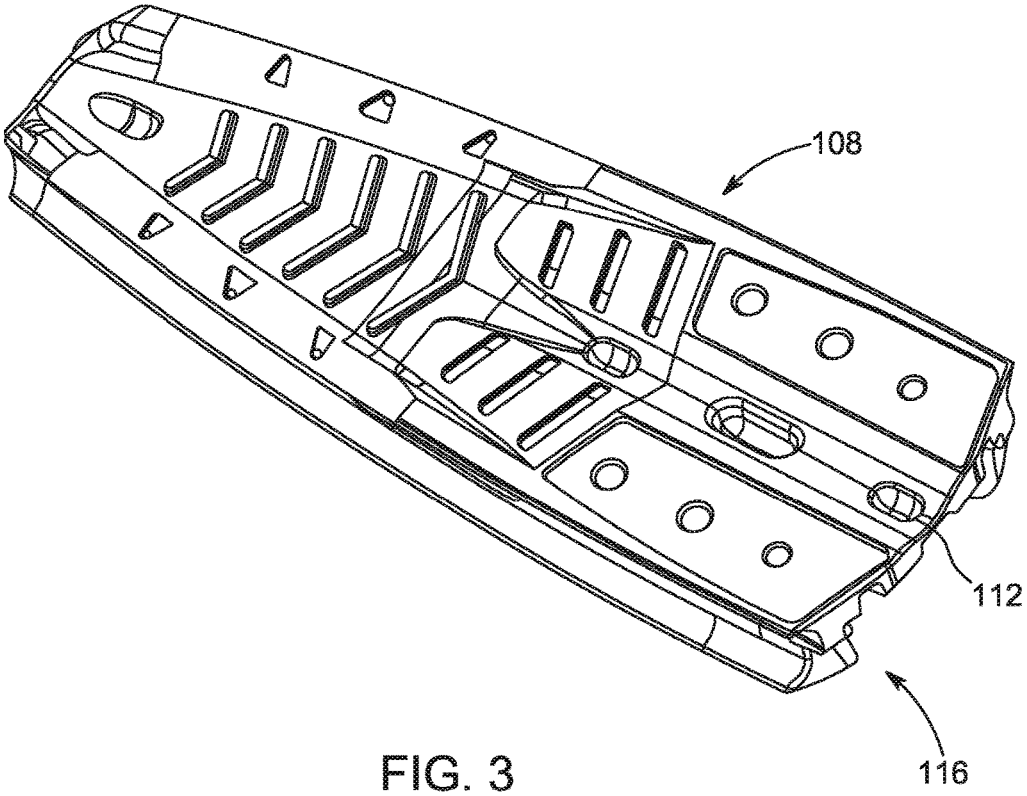
FIG. 3 is a perspective view of a stern portion of the central platform shown in FIG. 1.

With reference to FIGS. 2-3, and with continued reference to FIG. 1, the central platform 102 comprises a first or bow portion 106 and a second or stern portion 108. The bow portion 106 and the stern portion 108 are formed as separate components that are removably connectable to each other to define the central platform 102 of the watercraft 100. In this manner, the bow portion 106 and the stern portion 108 can be disconnected from each other when not in use to facilitate transport and storage of the central platform 102. Various bow portions 106 and stern portions 108 may be connected to each other to define a desired central platform 102. For example, a bow portion 106 having a propulsion mechanism may be fitted to stern portion 108 with a seat for use as a powered kayak. In other examples, the bow portion 106 and the stern portion 108 may be selected for use in a variety of watercraft 100, such as kayaks, stand-up paddle boards, and canoes.

In some embodiments or aspects, and with reference to FIGS. 2-3, the bow portion 106 has a first connector set 110 and the stern portion 108 has a second connector set 112. The first connector set 110 and the second connector set 112 are configured to releasably connect the bow portion 106 to the stern portion 108. For example, the first connector set 110 may include at least one protrusion 114 and the second connector set 112 may include at least one cavity 116 configured to removably receive the at least one protrusion 114. The at least one protrusion 114 is at least partially inserted into the at least one cavity 116 when the bow portion 106 is connected to the stern portion 108. In some embodiments or aspects, at least one of the bow portion 106 and the stern portion 108 may have a recess 137 having a carrying handle 139 for carrying the bow portion 106 or the stern portion 108 in a disassembled state.

In some embodiments or aspects, a locking mechanism may be provided to lock the bow portion 106 to the stern portion 108 when the first connector set 110 is connected to the second connector set 112. For example, the locking mechanism may be at least one of a pin and a clip that, when engaged, prevents removal of the bow portion 106 from the stern portion 108.

Figure 4A:
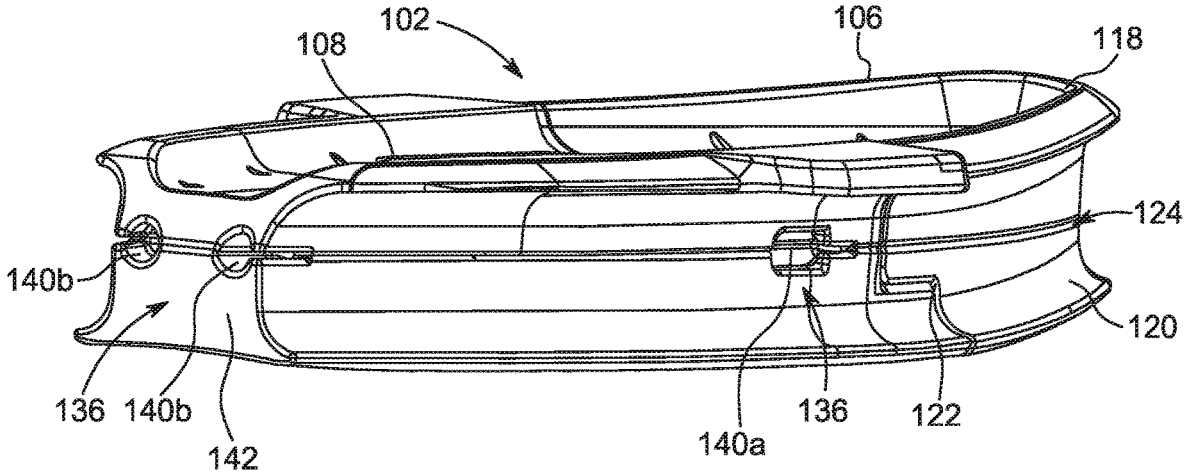
FIG. 4A is a rear perspective view of a central platform for a watercraft.

With reference to FIG. 4A, the central platform 102 has an upper flange 118 and a lower flange 120 each extending around at least a portion of an outer perimeter of the central platform 102. The upper flange 118 and the lower flange 120 are defined on at least a portion of the bow portion 106 and the stern portion 108. In some embodiments or aspects, the upper flange 118 and the lower flange 120 may extend around at least a portion of an outer perimeter of the bow portion 106 and the stern portion 108. In other embodiments or aspects, the upper flange 118 and the lower flange 120 may extend around an entire outer perimeter of the bow portion 106 and the stern portion 108.

With continued reference to FIG. 4A, the upper flange 118 and the lower flange 120 protrude outwardly from a body 122 of the central portion 102 such that the upper flange 118 and the lower flange 120 are separated by a recessed pocket or channel 124. In some embodiments or aspects, the recessed pocket or channel 124 may extend around at least a portion of an outer perimeter of the bow portion 106 and the stern portion 108. In other embodiments or aspects, the recessed pocket or channel 124 may extend around an entire outer perimeter of the bow portion 106 and the stern portion 108.

Figure 4B:
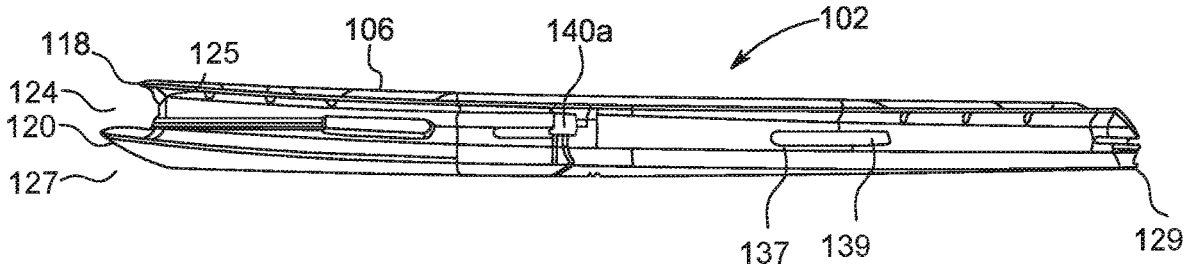
FIG. 4B is a side view of a central platform for a watercraft in accordance with another embodiment.

With reference to FIG. 4B, the recessed pocket or channel 124 has a notch 125 at a bow end 127. The notch 125 is further recessed into the recessed pocket or channel 124 in a direction toward the stern end 129 to permit the air-inflatable tube 104 to be secured to the central portion 102 prior to inflation of the air-inflatable tube 104. The notch 125 allows the air-inflatable tube 104 to be pulled back toward the stern end 129 to permit connection of the locking elements on the central portion 102 and the air-inflatable tube 104, as described herein.

The central portion 102 may be made from a rigid material, such as a rigid plastic material. In some embodiments or aspects, the central portion 102 may be made from a roto-molded polyethylene resin. In some embodiments or aspects, the central portion 102 may be made from a thermoformed plastic material, plastic sheet material, ABS plastic, resin-impregnated laminate material (fiberglass, aramid, carbon fiber), polycarbonate, wood, and any combination thereof.

Figure 5:
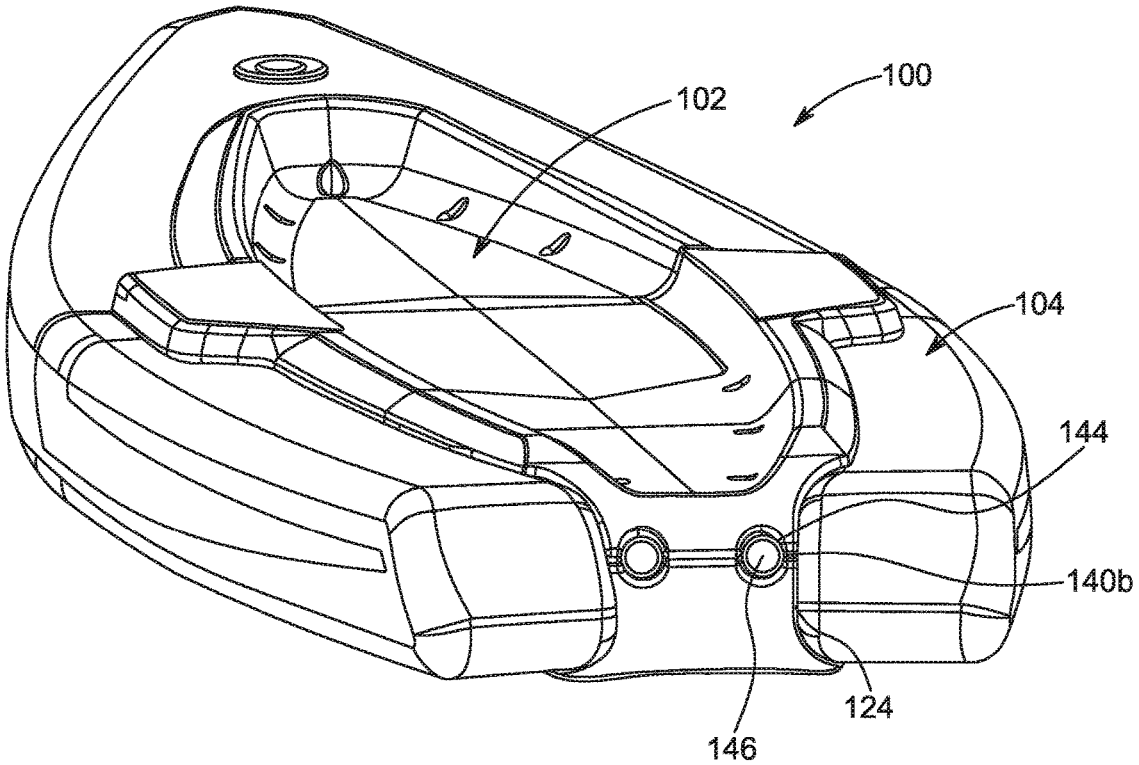
FIG. 5 is a rear perspective view of the central platform and an air-inflatable tube fitted around the central platform.

With reference to FIG. 5, the air-inflatable tube 104 may be shaped to interface with the recessed pocket 124 of the central portion 102. For example, when inflated, the air-inflatable tube 104 may be at least partially received within the recessed pocket or channel 124 around at least a portion of the outer perimeter of the central platform 102. For example, the air-inflatable tube 104 may extend along a portion of the length of the recessed pocket 124 extending around the outer perimeter of the central platform 102. In some embodiments or aspects, the air-inflatable tube 104 may have an annular shape such that the air-inflatable tube 104 extends along the entire recessed pocket 124 of the central platform 102. When inflated, the air-inflatable tube 104 is securely received within the recessed pocket 124 in a manner similar to how a pneumatic tire is fitted onto a rim of a vehicle.

Figure 6:
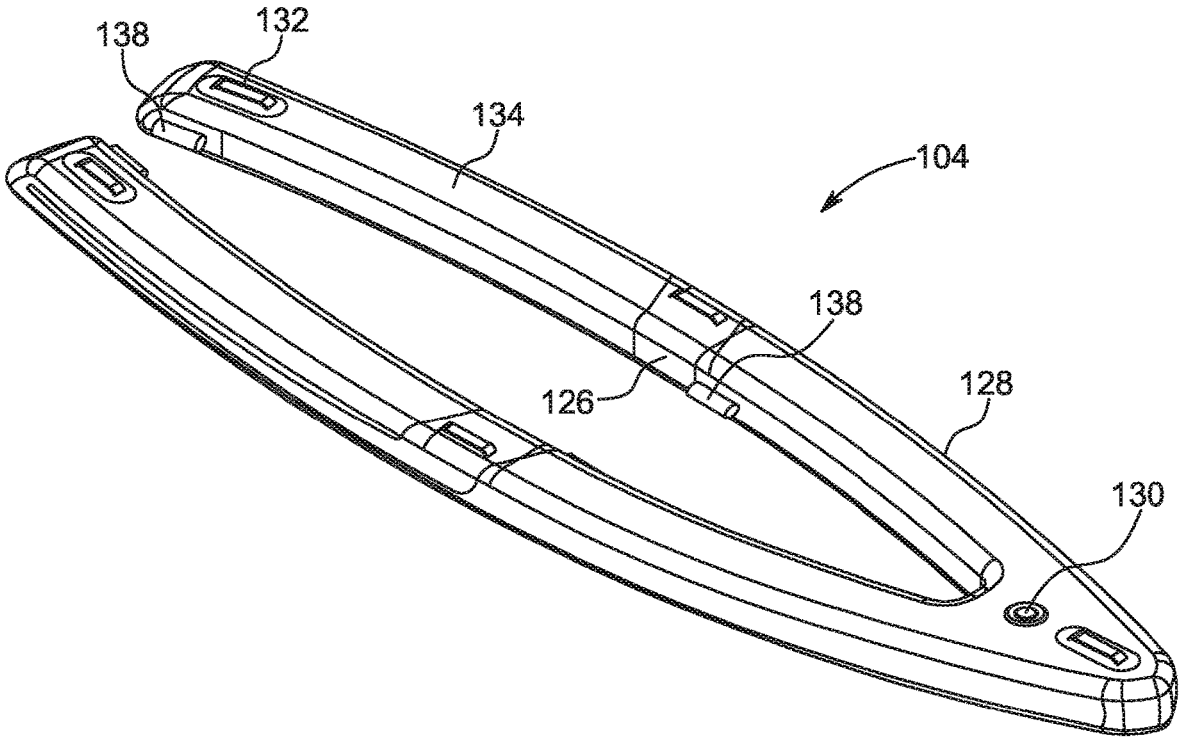
FIG. 6 is a perspective view of an air-inflatable tube for a watercraft.
Figure 7:
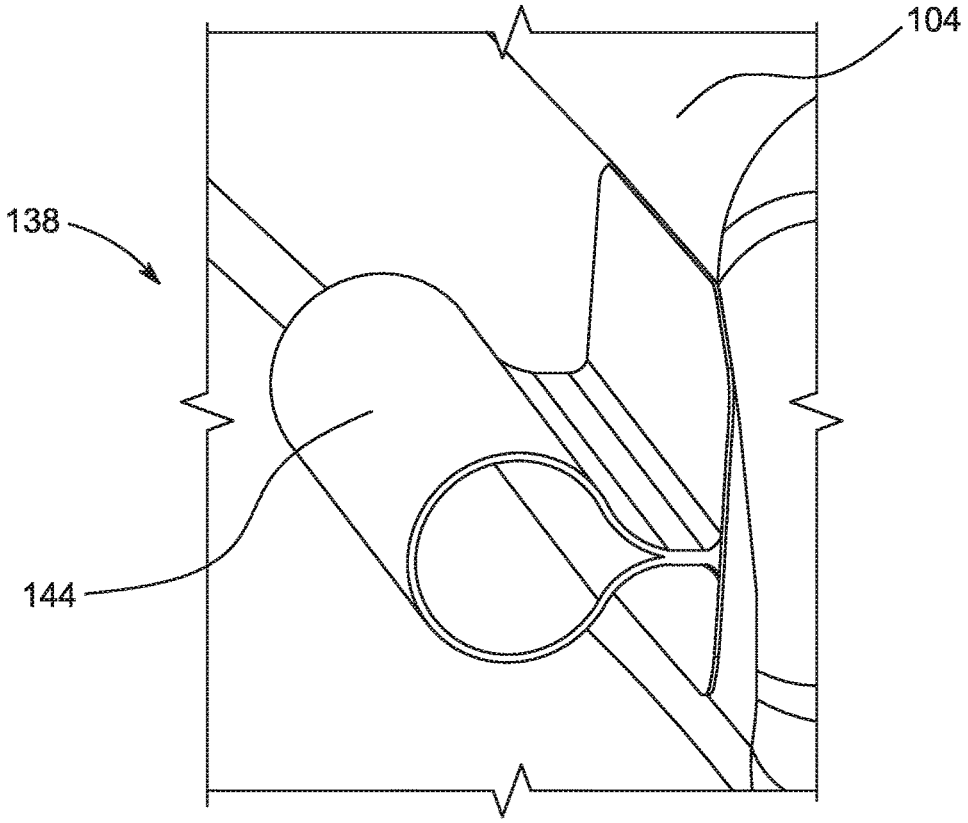
FIG. 7 is a detailed perspective view of a connector on the air-inflatable tube for connecting to a central platform of a watercraft.

With reference to FIGS. 6-7, the air-inflatable tube 104 has an inner surface 126 configured for contacting the recessed pocket 124 and an outer surface 128 that defines an exterior shape of the watercraft 100 (shown in FIG. 1). The outer surface 128 may be shaped to have desired hydrodynamic properties for a given watercraft 100. In some embodiments or aspects, the air-inflatable tube 104 may be exchangeable with another air-inflatable tube 104 having a different shape. In this manner, the watercraft 100 can be configured for a desired purpose, such has having a long and narrow hull for speed, or a short and wide hull for stability. No specific tools are required for installing or removing the air-inflatable tube 104.

With continued reference to FIG. 6, the air-inflatable tube 104 has an air port 130 configured for inflating or deflating the air-inflatable tube 104. In some embodiments or aspects, when deflated, the air-inflatable tube 104 can be rolled up or folded to minimize its footprint during transport or storage. The air-inflatable tube 104 may have one or more grab handles 132 on its upper surface 134 for carrying the watercraft 100. The one or more grab handles 132 may be strips of flexible material that are sewn or otherwise connected to the upper surface 134 of the air-inflatable tube 104.

The central platform 102 and the air-inflatable tube 104 may be configured for lockably connecting with each other. With reference to FIGS. 4 and 7, the central platform 102 includes at least one first locking element 136 and the air-inflatable tube 104 has at least one second locking element 138 that is configured for interacting with the at least one first locking element 136. The at least one first locking element 136 and the at least one second locking element 138 may be configured for locking engagement with each other.

Figure 8:
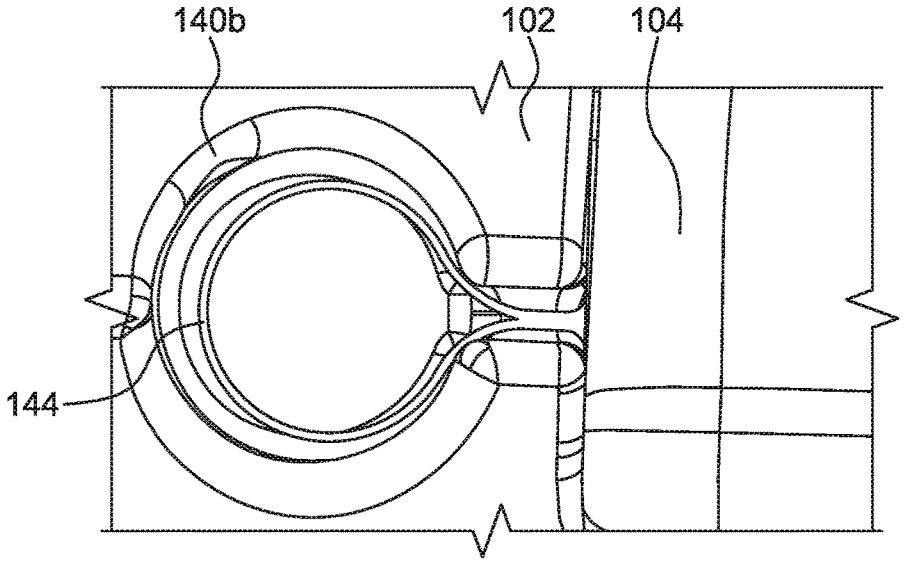
FIG. 8 is a detailed rear view of the watercraft showing a connection mechanism between the central platform and the air-inflatable tube.
Figure 9:
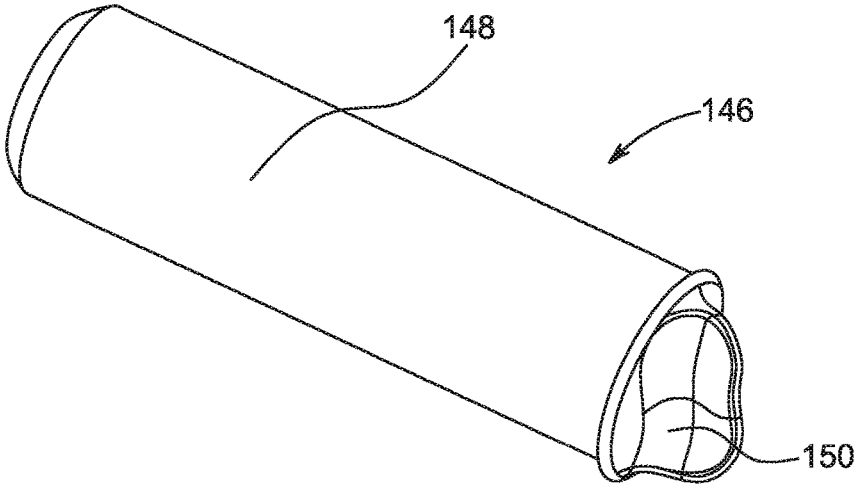
FIG. 9 is a perspective view of a locking plug for locking the central platform and the air-inflatable tube.

In some embodiments or aspects, the at least one first locking element 136 may be a slotted channel. For example, as shown in FIG. 4, the central platform 102 may have a first set of slotted channels 140*a* on the left or port side and the right or starboard side, and a second set of slotted channels 140*b* at a stern end 142. As shown in FIG. 7, the at least one second locking element 138 may be a flexible fabric loop 144 configured to be received within the slotted channel 140*a*, 140*b* (see FIG. 8). As shown in FIG. 5, a locking plug 146 may be received in the flexible fabric loop 144 to lock the flexible fabric loop 144 within the slotted channel 140*a*, 140*b*. With reference to FIG. 9, the locking plug 146 has a cylindrical body 148 shaped to be received in a cavity defined by the flexible fabric loop 144 that is fitted within the slotted channel 140*a*, 140*b*. The locking plug 146 further has a tab 150 protruding from one end of the cylindrical body 140. The tab 150 may be configured for handling the locking plug 146 during insertion and removal from the cavity defined by the flexible fabric loop 144 that is fitted within the slotted channel 140*a*, 140*b*. The air-inflatable tube 104 is configured for lockably connecting to the central platform 102 when the air-inflatable tube 104 is in a deflated state. In order to permit connection of the first and second locking elements 136, 138, the air-inflatable tube 104 may be pulled toward the stern end 129 such that at least a portion of the air-inflatable tube 104 is received within the notch 125 (shown in FIG. 4B). Once inflated, the air-inflatable tube 104 fills the recessed pocket or channel 124 to prevent removal of the air-inflatable tube 104 from the central platform 102.

Figure 10:
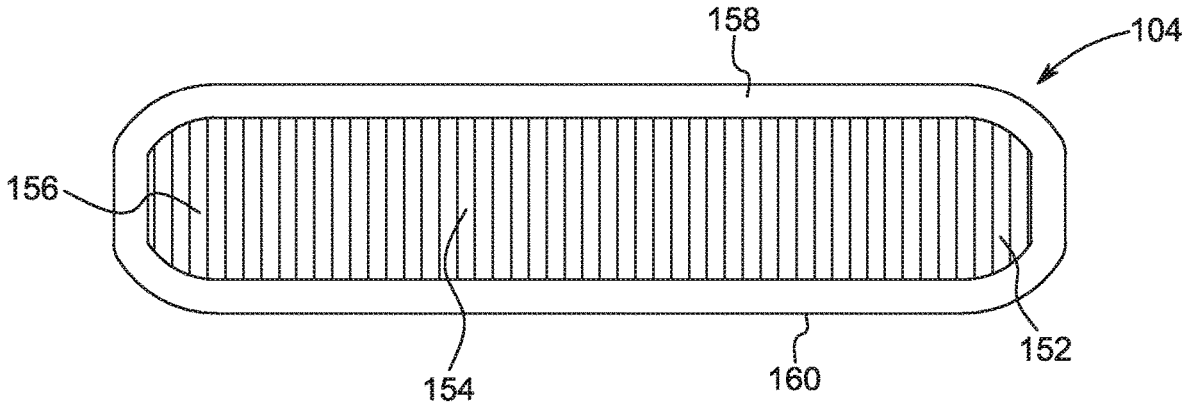
FIG. 10 is a cross-sectional view of an exemplary air-inflatable tube.

The air-inflatable tube 104 may be made from a flexible plastic material that permits inflation and deflation of the air-inflatable tube 104. In some embodiments or aspects, the air-inflatable tube 104 may be made from a drop stitched fabric material. The use of such material allows for increased rigidity of the air-inflatable tube 104 while allowing use of lower inflation pressures. For example, with reference to FIG. 10, the air-inflatable tube 104 may include a drop-stitched core 152 having a plurality of threads 154 extending through an inner cavity 156 between opposing surfaces 158, 160.

Figure 11:
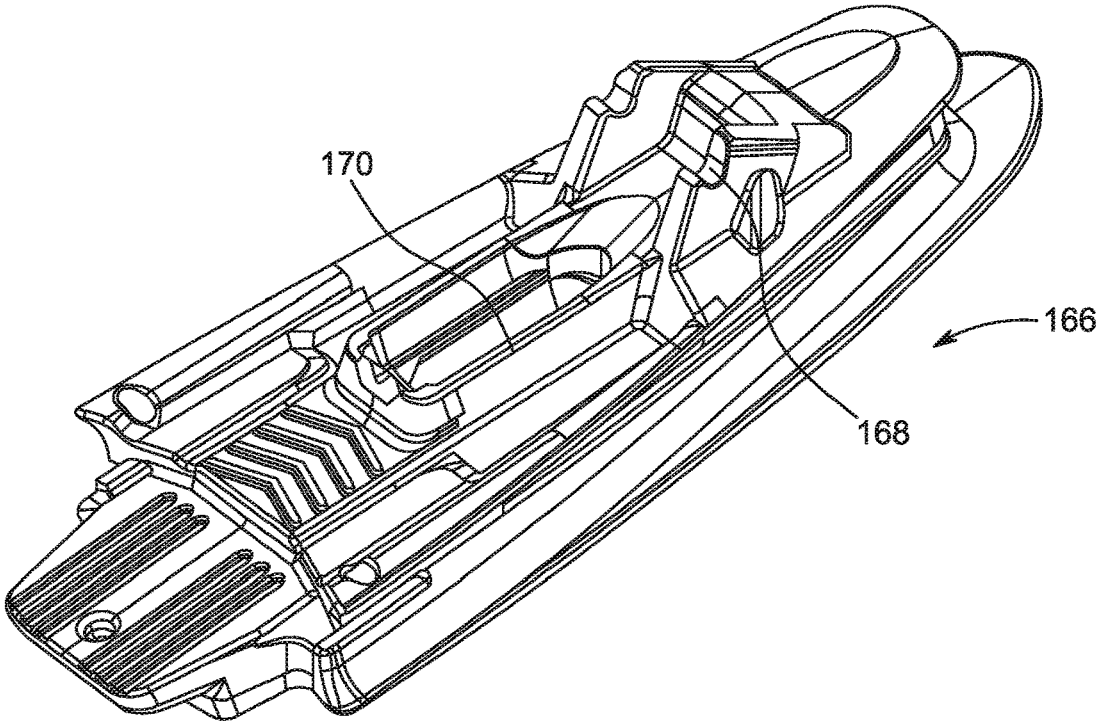
FIG. 11 is a perspective view of a bow portion in accordance with some non-limiting embodiments or aspects of the present-disclosure.

With reference to FIG. 11, a bow portion 166 is shown in accordance with another embodiment or aspect of the present disclosure. The bow portion 166 may be identical to the bow portion 106 described herein with reference to FIG. 2, with the exception that the bow portion 166 shown in FIG. 11 is configure for use with a propulsion mechanism. The bow portion 166 may have a support 168 for supporting the propulsion mechanism. An opening 170 may extend through the bow portion 166 to permit the propulsion mechanism to extend into the water.

Figure 12:
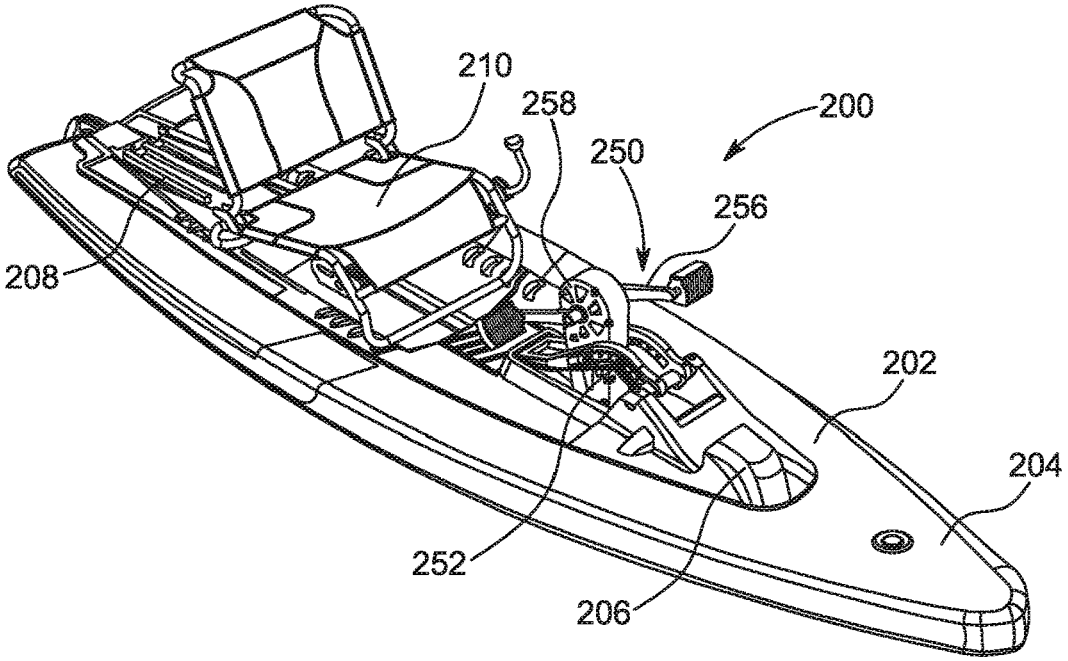
FIG. 12 is a top perspective view of a watercraft in accordance with some non-limiting embodiments or aspects of the present disclosure.

With reference to FIG. 12, a watercraft 200 is shown in accordance with another embodiment or aspect of the present disclosure. The watercraft 200 generally includes a central platform 202 and an air-inflatable tube 204 fitted around at least a portion of an outer perimeter of the central platform 102. The central platform 202 comprises a first or bow portion 206 and a second or stern portion 208 that are formed as separate components and are removably connectable to each other. The watercraft 200 further includes a seat 210 on the central platform 202 for supporting a user. The watercraft 200 also includes a propulsion mechanism 250 connected to the central platform 202. In some embodiments or aspects, the propulsion mechanism 250 may be provided on one of the first portion 206 and the second portion 208. In other embodiments or aspects, separate propulsion mechanisms 250 may be provided on each of the first portion 206 and the second portion 208. The propulsion mechanism 250 may be configured to provide motive power to the watercraft 200.

In some embodiments or aspects, the propulsion mechanism 250 may be a manual propulsion mechanism configured to receive mechanical input from a user. In some embodiments or aspects, the propulsion mechanism 250 may be a motor propulsion mechanism configured to receive mechanical input from an electric motor. In further embodiments or aspects, the propulsion mechanism 250 may be a hybrid propulsion mechanism configured to receive a first mechanical input from a user and a second mechanical input from an electric motor. The electric motor may be powered by a power source, such as a battery. In embodiments or aspects where there are two propulsion mechanisms 250, the propulsion mechanisms 250 may be used individually or in combination. For example, the first portion 206 may have a first propulsion mechanism 250 that is a manual propulsion mechanism and the second portion 208 may have a second propulsion mechanism 250 that is a motor propulsion mechanism. The second propulsion mechanism 250 may be used to supplement the power provided by the first propulsion mechanism 250. For example, when actuated, the second propulsion mechanism 250 may have a sensor for detecting water flow. Based on the input from the sensor, the second propulsion mechanism 250 may provide a corresponding power output to supplement the output provided by the first propulsion mechanism 250.

The propulsion mechanism 250 may be removably or non-removably connected to the watercraft 200. The propulsion mechanism 250 generally includes a frame 252 configured for installation on the watercraft 200, such as the support 268 on the bow portion 206. The propulsion mechanism 250 may have a main housing for receiving a manual drive mechanism 256 and/or a motor drive mechanism 258. The manual drive mechanism 256 is configured to receive mechanical input from the user, such as through rotation of the pedals, and transfer this mechanical input into rotation of a propeller. The motor drive mechanism 258 is configured to receive mechanical input from a motor and transfer this mechanical input into rotation of the propeller.

The manual drive mechanism 256 and the motor drive mechanism 258 may be operated individually (i.e., operation of one prevents operation of the other). For example, during operation of the manual drive mechanism 256, the motor drive mechanism 256 may be disconnected such that input from the motor cannot be transferred to drive the propeller. In other embodiments or aspects, the manual drive mechanism 256 and the motor drive mechanism 258 may be operated synchronously such that the mechanical input by the user through rotation of the pedals is supplemented by the mechanical input from the motor.

The frame 252 is configured to allow the propulsion mechanism 250 to be lowered or raised relative to the hull of the watercraft 200. In this manner, the propeller can be lowered or raised to reduce the likelihood of impact between the propeller and any underwater obstacles, such as rocks. At least a portion of the frame 252 may be movable relative to the hull of the watercraft 200 to cause the propulsion mechanism 250 to be moved between a fully extended position, a partially extended position, and a retracted position.

The non-limiting embodiments or aspects of the present disclosure have been described in detail herein. However, it will be appreciated by those skilled in the art that various modifications and alternatives to the embodiments or aspects may be made without departing from the concepts disclosed in the foregoing description. Such modifications are to be considered as included within the following claims unless the claims, by their language, expressly state otherwise. Accordingly, the particular embodiments or aspects described in detail hereinabove are illustrative only and are not limiting as to the scope of the disclosure, which is to be given the full breadth of the appended claims and any and all equivalents thereof.

What is claimed is:

1. A watercraft comprising:

a central platform comprising a bow portion and a stern portion removably connectable to each other to define a rigid hull; and an air-inflatable tube fitted around at least a portion of an outer perimeter of the central platform, wherein, when inflated, the air-inflatable tube is at least partially received within a recessed pocket extending around at least a portion of the outer perimeter of the central platform, and wherein the air-inflatable tube comprises a drop-stitched core having a plurality of threads extending through an inner cavity between opposing surfaces.

2. The watercraft of claim 1, wherein the bow portion comprises a first connector set and the stern portion comprises a second connector set, and wherein the first connector set and the second connector set are configured to releasably connect the bow portion to the stern portion.

3. The watercraft of claim 2, wherein the first connector set comprises a protrusion and wherein the second connector set comprises a cavity, and wherein the protrusion is at least partially inserted into the cavity when the bow portion is connected to the stern portion.

4. The watercraft of claim 1, wherein the central platform comprises an upper flange and a lower flange each extending around at least a portion of an outer perimeter of the central platform, and wherein the upper flange and the lower flange are separated by the recessed pocket.

5. The watercraft of claim 1, wherein the central platform comprises at least one first locking element, wherein the air-inflatable tube comprises at least one second locking element, and wherein the at least one first locking element and the at least one second locking element are configured for locking engagement with each other.

6. The watercraft of claim 5, wherein the at least one first locking element is a slotted channel.

7. The watercraft of claim 6, wherein the at least one second locking element is a flexible fabric loop configured to be received within the slotted channel.

8. The watercraft of claim 7, further comprising a locking plug received in the flexible fabric loop to lock the flexible fabric loop within the slotted channel.

9. The watercraft of claim 1, wherein the central platform is made from a rigid plastic material.

10. The watercraft of claim 1, wherein the air-inflatable tube is made from a flexible plastic material or a drop stitched fabric material.

11. The watercraft of claim 1, further comprising a propulsion mechanism connected to the central platform, wherein the propulsion mechanism is configured to provide motive power to the watercraft.

12. The watercraft of claim 11, wherein the propulsion mechanism is a manual propulsion mechanism configured to receive mechanical input from a user, or wherein the propulsion mechanism is a motor propulsion mechanism configured to receive mechanical input from an electric motor.

13. The watercraft of claim 11, wherein the propulsion mechanism is a hybrid propulsion mechanism configured to receive a first mechanical input from a user and a second mechanical input from an electric motor.

14. The watercraft of claim 1, wherein the watercraft is a kayak, a stand-up paddle board, or a canoe.

15. A watercraft comprising:

a central platform comprising a bow portion and a stern portion removably connectable to each other to define a rigid hull, the central platform comprising an upper flange and a lower flange each extending around at least a portion of an outer perimeter of the central platform, wherein the upper flange and the lower flange are separated by a recessed pocket; and an air-inflatable tube fitted around at least a portion of an outer perimeter of the rigid hull, wherein, when inflated, the air-inflatable tube is at least partially received within the recessed pocket, wherein the central platform comprises at least one first locking element, wherein the air-inflatable tube comprises at least one second locking element, wherein the at least one first locking element and the at least one second locking element are configured for locking engagement with each other, and wherein the air-inflatable tube is made from a flexible plastic material or a fabric material with a drop-stitched core having a plurality of threads extending through an inner cavity between opposing surfaces.

16. The watercraft of claim 15, wherein the bow portion comprises a first connector set and the stern portion comprises a second connector set, and wherein the first connector set and the second connector set are configured to releasably connect the bow portion to the stern portion.

17. The watercraft of claim 15, further comprising a propulsion mechanism connected to the central platform, wherein the propulsion mechanism is configured to provide motive power to the watercraft.

18. The watercraft of claim 15, wherein the central platform is made from a rigid plastic material.

19. A watercraft comprising:

a central platform comprising a bow portion and a stern portion removably connectable to each other to define a rigid hull, the central platform comprising an upper flange and a lower flange each extending around at least a portion of an outer perimeter of the central platform, wherein the upper flange and the lower flange are separated by a recessed pocket; and an air-inflatable tube comprising a drop-stitched core having a plurality of threads extending through an inner cavity between opposing surfaces, the air-inflatable tube configured for being fitted around at least a portion of an outer perimeter of the central platform, wherein, when inflated, the air-inflatable tube is at least partially received within the recessed pocket, wherein the central platform comprises at least one first locking element, wherein the air-inflatable tube comprises at least one second locking element, and wherein the at least one first locking element and the at least one second locking element are configured for locking engagement with each other.

* * * * *